US008529413B2

(12) United States Patent
Simmons

(10) Patent No.: US 8,529,413 B2
(45) Date of Patent: Sep. 10, 2013

(54) APPARATUS AND METHOD FOR LOWER BACK EXERCISE

(75) Inventor: Louis J. Simmons, Grove City, OH (US)

(73) Assignee: Tee and Ell Weight Lifting and Exercise Enterprises, Inc., Columbus, OH (US)

( * ) Notice: Subject to any disclaimer, the term of this patent is extended or adjusted under 35 U.S.C. 154(b) by 323 days.

(21) Appl. No.: 12/978,990

(22) Filed: Dec. 27, 2010

(65) Prior Publication Data

US 2012/0165168 A1 Jun. 28, 2012

(51) Int. Cl.
*A63B 21/08* (2006.01)
*A63B 21/068* (2006.01)
*A63B 21/00* (2006.01)

(52) U.S. Cl.
USPC ..... 482/100; 481/97; 481/137

(58) Field of Classification Search
USPC ..... 482/100, 135–139, 145, 146, 51–52, 482/70–71, 79–80, 92–94, 97–98, 133, 142
See application file for complete search history.

(56) References Cited

U.S. PATENT DOCUMENTS

| | | | | |
|---|---|---|---|---|
| 2,921,791 | A * | 1/1960 | Berne | 482/118 |
| 3,120,954 | A * | 2/1964 | Apostol | 482/97 |
| 3,759,511 | A * | 9/1973 | Zinkin et al. | 482/51 |
| 4,407,496 | A * | 10/1983 | Johnson | 482/97 |
| 4,502,681 | A * | 3/1985 | Blomqvist | 482/130 |
| 4,509,746 | A | 4/1985 | Mask | |
| 4,749,190 | A | 6/1988 | Jennings | |
| 4,813,666 | A | 3/1989 | Costilow et al. | |
| 5,020,795 | A * | 6/1991 | Airy et al. | 482/5 |
| 5,066,003 | A * | 11/1991 | Jones | 482/137 |
| 5,066,004 | A * | 11/1991 | Jones | 482/137 |
| 5,184,991 | A * | 2/1993 | Brangi | 482/97 |
| 5,356,359 | A | 10/1994 | Simmons | |
| 5,554,084 | A | 9/1996 | Jones | |
| 5,562,579 | A | 10/1996 | Sheikowitz | |
| 5,669,860 | A | 9/1997 | Reyes | |
| 5,897,473 | A | 4/1999 | Koenig | |
| 5,941,804 | A * | 8/1999 | Johnston et al. | 482/97 |
| 6,196,948 | B1 * | 3/2001 | Stearns et al. | 482/52 |

(Continued)

FOREIGN PATENT DOCUMENTS

| | | | |
|---|---|---|---|
| AU | 200197419 | A1 | 6/2002 |
| DE | 20110516 | U1 * | 11/2001 |
| FR | 2703595 | A1 | 10/1994 |

*Primary Examiner* — Oren Ginsberg
(74) *Attorney, Agent, or Firm* — John A. Thomas

(57) ABSTRACT

An apparatus for exercise of the lower back, has a support frame capable of supporting the body of a person exercising. The support frame supports left and right pendulums, for left and right legs, respectively. Each of the left and right pendulums further has an arm that is pivotably connected to the support frame, so that each of the left and right pendulums may pivot about the pivotable connection independently of the other. A resistance transfer apparatus is moveably coupled to the other end of the pendulum arm. The resistance transfer apparatus includes a bar for engaging the lower leg or ankle of a person exercising, and a coupling for moveably coupling the resistance transfer apparatus to the arm of the pendulum, so that the resistance transfer apparatus can pivot in substantially the same plane of movement as that of the pendulum. Use of the exercise apparatus raises the user's legs from the hanging vertical to the horizontal against the resistance of the weighted pendulums. As the legs are lowered, the leg and lower back muscles also resist the weight of the pendulums.

3 Claims, 8 Drawing Sheets

(56) References Cited

U.S. PATENT DOCUMENTS

| | | | | |
|---|---|---|---|---|
| 6,491,607 | B2 | 12/2002 | Simmons et al. | |
| 6,605,024 | B2 | 8/2003 | Stearns | |
| 7,435,207 | B2 * | 10/2008 | Cook et al. | 482/142 |
| 7,473,212 | B2 | 1/2009 | Simmons | |
| 7,691,041 | B2 | 4/2010 | Abdo | |
| 8,267,843 | B2 * | 9/2012 | Dellino | 482/137 |

* cited by examiner

APPARATUS AND METHOD FOR LOWER BACK EXERCISE

BACKGROUND

1. Technical Field

This disclosure relates to an improved apparatus and method for exercising and strengthening the lower back.

2. Background

Back muscle and cartilage injuries, especially in the lower lumbar region of the back are relatively common. Such injuries are especially common in persons who have failed to maintain the conditioning and tone of the muscles that support the lower back. These muscles, the spinal erectors and hip flexor, must be maintained in reasonable condition if such muscle and cartilage injuries are to be protected against.

Additionally, once injury has occurred, healing can be promoted by increasing the flow of blood to the injured muscles and the areas surrounding the injury. Unfortunately, the number and density of blood vessels in the lower back area is relatively low. Exercise, however, is believed by many to stimulate increased blood flow. A drawback to most forms of exercise is the risk or tendency of hyperextension of the already injured muscles thereby aggravating the injury rather than promoting healing of the muscles, cartilage and surrounding tissues.

There have been a number of attempts to exercise the back and other body parts to increase muscle tone and stimulate the flow of blood to muscles and tissues, such as devices having one section in which the user lies on his side, and a second section attached to the user's legs, which the user rotates about a vertical axis; or machines including a horizontal torso support from which the legs hang vertically downward; the user then lifts his legs to the horizontal to exercise the lower back.

However, none of these previous attempts have met the exercise needs of individuals who have already sustained lower back injuries or whose lower back areas are too out-of-condition to be able to withstand rigorous exercise. In order for exercise to be of value, it must progressively increase in intensity. A common method of increasing the intensity of an exercise is through the use of increased resistance from static weight additions. However, adding weight to an exercise can increase the hyperextension of lower back muscles. Therefore, weight training is not generally recommended for those suffering from lower back muscle, tissue and cartilage injuries.

There is a need for a method of exercise and an exercise apparatus that avoids hyperextension of lower back muscles while providing for conditioning and muscle tone, and which can increase local blood circulation to injured muscles and tissues in the lower back. There is also a need for an exercise that can permit progressive intensity of the work out to strengthen lower back muscles, tissues and provide increased blood flow to those areas. U.S. Pat. No. 7,473,212 to Applicant Louis J. Simmons, the disclosure of which patent is incorporated into the present disclosure in its entirety, but which is not admitted to be prior art by its inclusion in this background section, partly addresses these needs. The present application is an improved apparatus allowing for independent exercise of the legs and back muscles associated with them, as well as presenting other novel features.

DRAWINGS

DESCRIPTION

Figure 1:
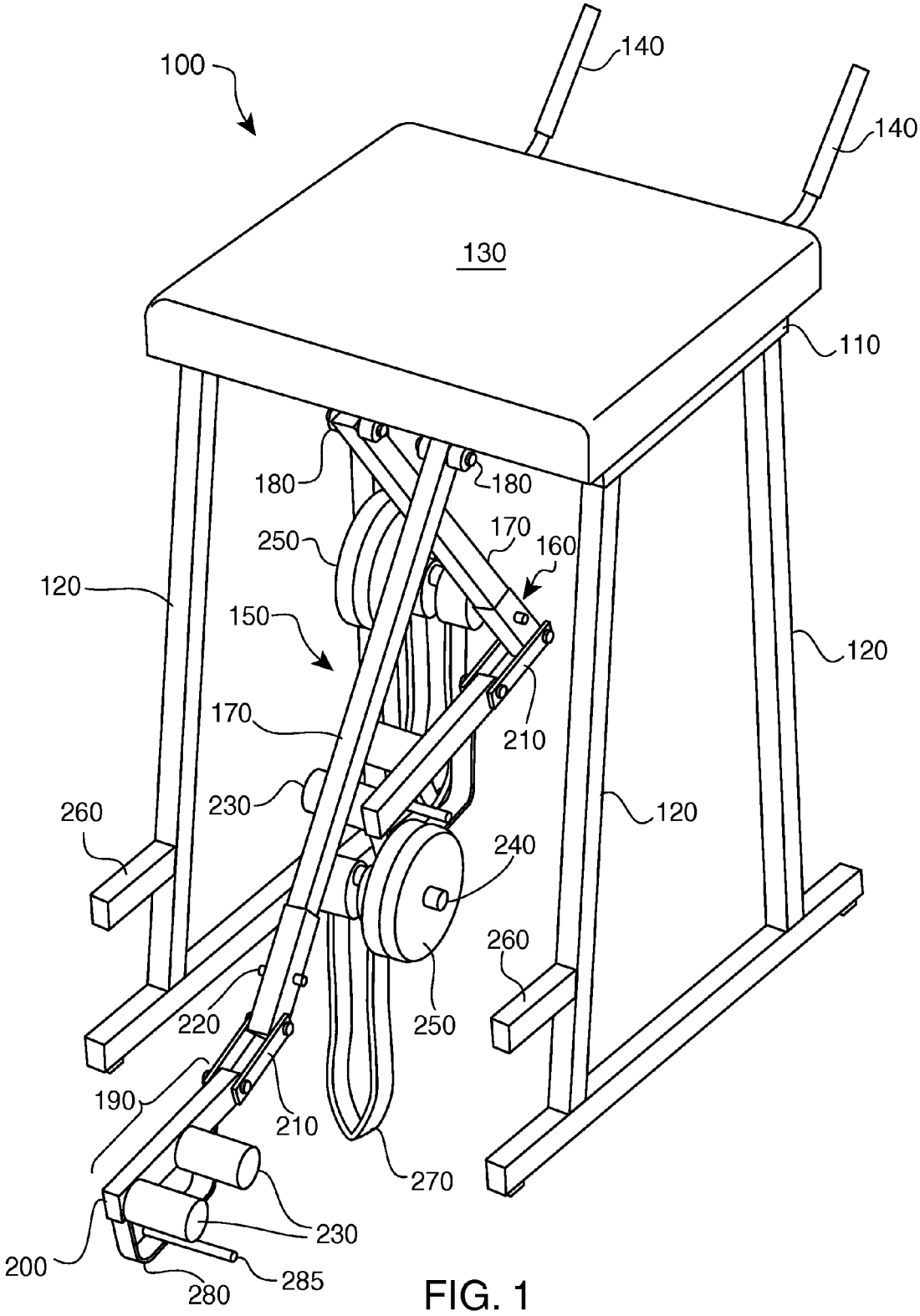
FIG. 1 is a perspective view of an embodiment of the exercise apparatus.
Figure 2:
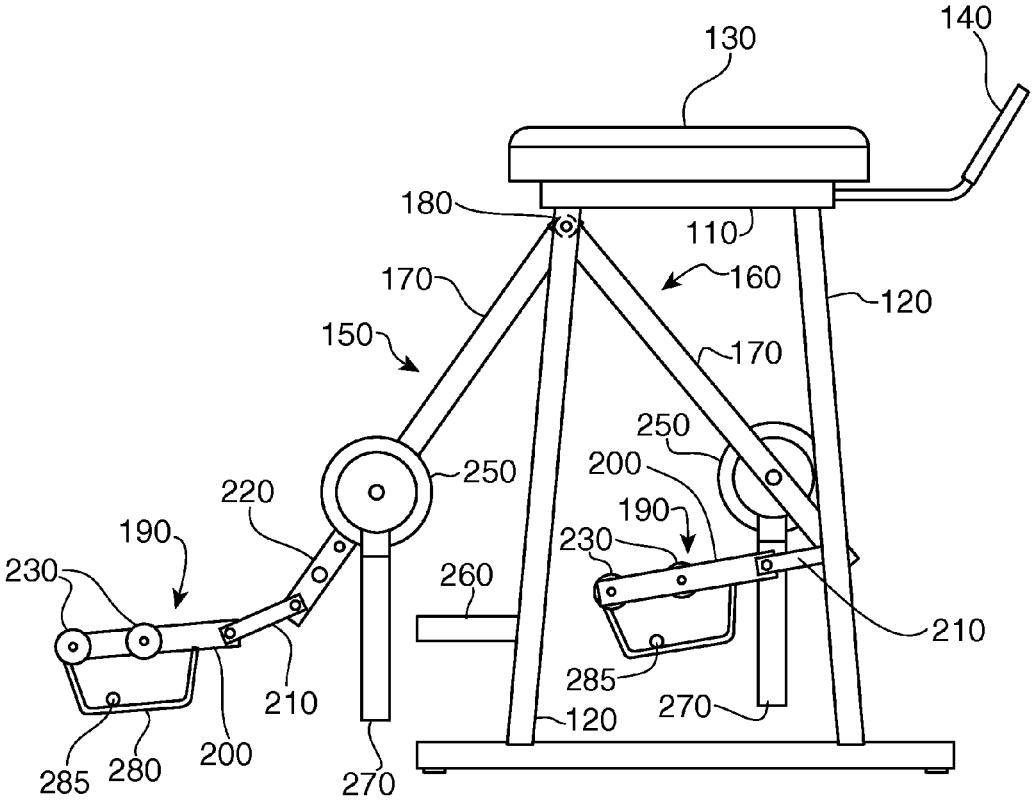
FIG. 2 is a side view of the same embodiment, showing elements of another embodiment.
Figure 3:
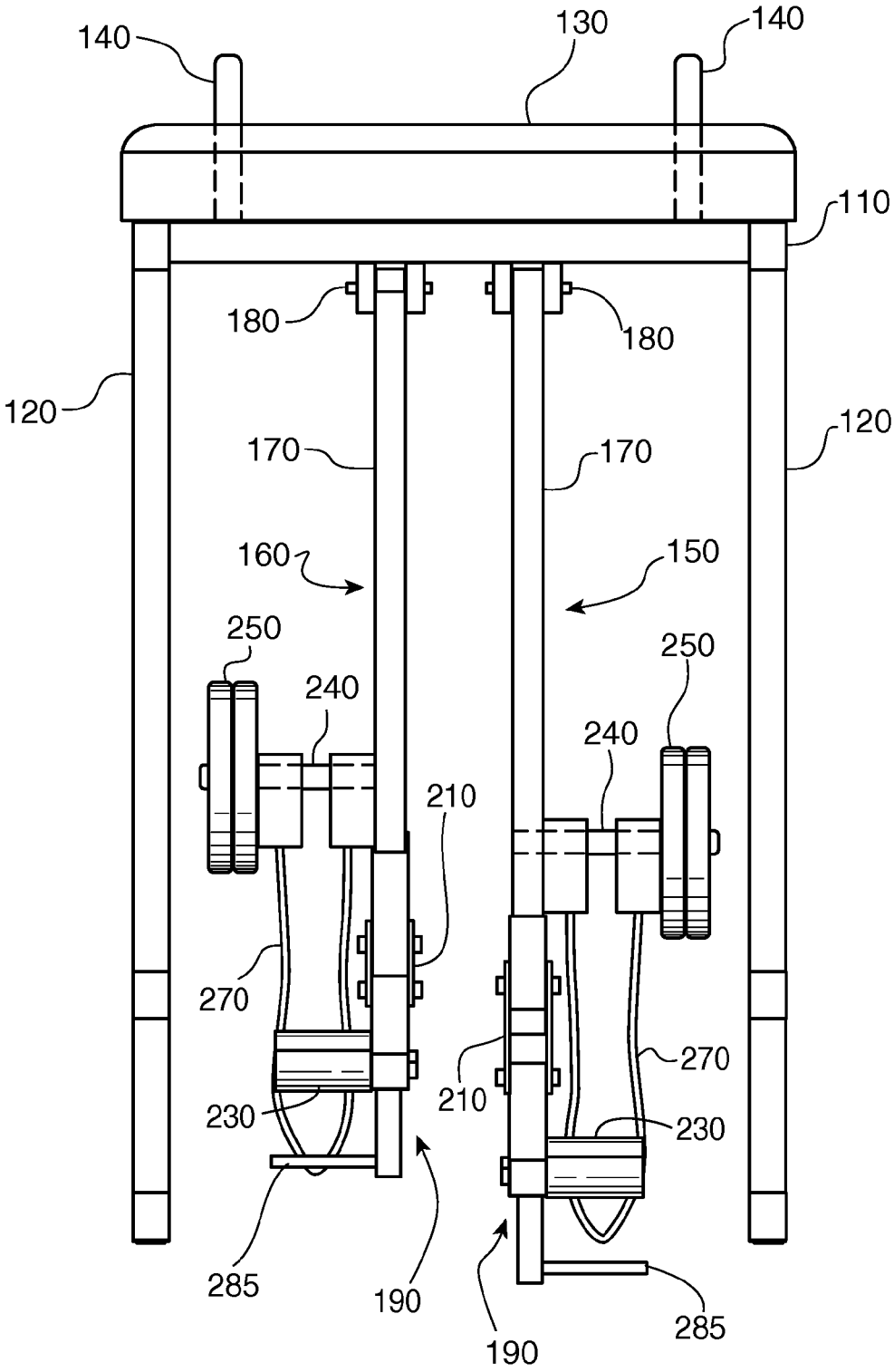
FIG. 3 is a rear view of the same embodiment, showing elements of another embodiment.

As shown in FIGS. 1-3, the exercise apparatus (100) has a frame (110), preferably made of steel for strength. The frame (110) is supported by legs (120). The top of the frame (110) preferably has a padded body-support platform (130) to support the user's body. This embodiment has optional handgrips (140) to assist the user in mounting the apparatus (100) and holding himself or herself in exercise position; that is, belly down, with the legs rearward.

In this disclosure, the "forward" direction with respect to the apparatus is to the right in FIG. 2, and the "rearward" direction is to the left in FIG. 2.

FIGS. 1-3 show a right pendulum (150) and a left pendulum (160) connected to the frame (110) at pivots (180). The pivots may be merely holes in a flange engaging a pin, but are preferably ball bearings, allowing the pendulums (150, 160) to pivot independently of one another, as shown most clearly in FIGS. 1 and 2. Each of the right pendulum (150) and the left pendulum (160) comprises an arm (170); the arm (170) pivotably connects the respective pendulums (150, 160) to the frame (110) at the pivots (180).

First Embodiment

Each arm (170) is connected to a resistance transfer apparatus (190) by means of a pivoting linkage (210). The connection of each pivoting linkage (210) to the arms (170) is preferably adjustable by means of a sleeve and pin combination (220), but the pivoting linkage (210) may be connected directly to the arm (170). The resistance transfer apparatus (190) comprises a second arm (200). This second arm (200) preferably has padded bars (230) extending approximately perpendicular to it, to engage the lower legs of the person exercising, generally by holding the bars (230) with the ankles, thus working the back muscles against the resistance of raising and lower the pendulums (150, 160). An optional skid (280) may be connected to the second arm (200) to lift either resistance transfer apparatus (190, 350) off the ground and make it easier for the person exercising to slide his or her feet into place.

A transverse rod (285) is preferably provided so that the user can place his or her foot thereon to work the gluteals and hamstrings.

Each arm (170) preferably has some means for adding resistance to the movement of the right pendulum (150) and left pendulum (160). In the figures, this means is shown as a post (240) connected approximately perpendicular to the respective arms (170), for supporting conventional weight disks (250). The frame (110) preferably has foot steps (260) connected to it to assist the user in mounting the apparatus (100) and assuming the correct position for exercise.

Second Embodiment

In another embodiment, a strap (270) may be connected to the each of the arms (170) of the respective right pendulum (150) and left pendulum (160), as shown in FIGS. 1-3. The straps (270), as an alternate resistance transfer apparatus, may be connected whether the previously disclosed resistance transfer apparatus (190) is present or not. The person exercising can slip his or her ankles into the straps (270) and work against the resistance afforded by the weights (250).

Third Embodiment

Figure 4:
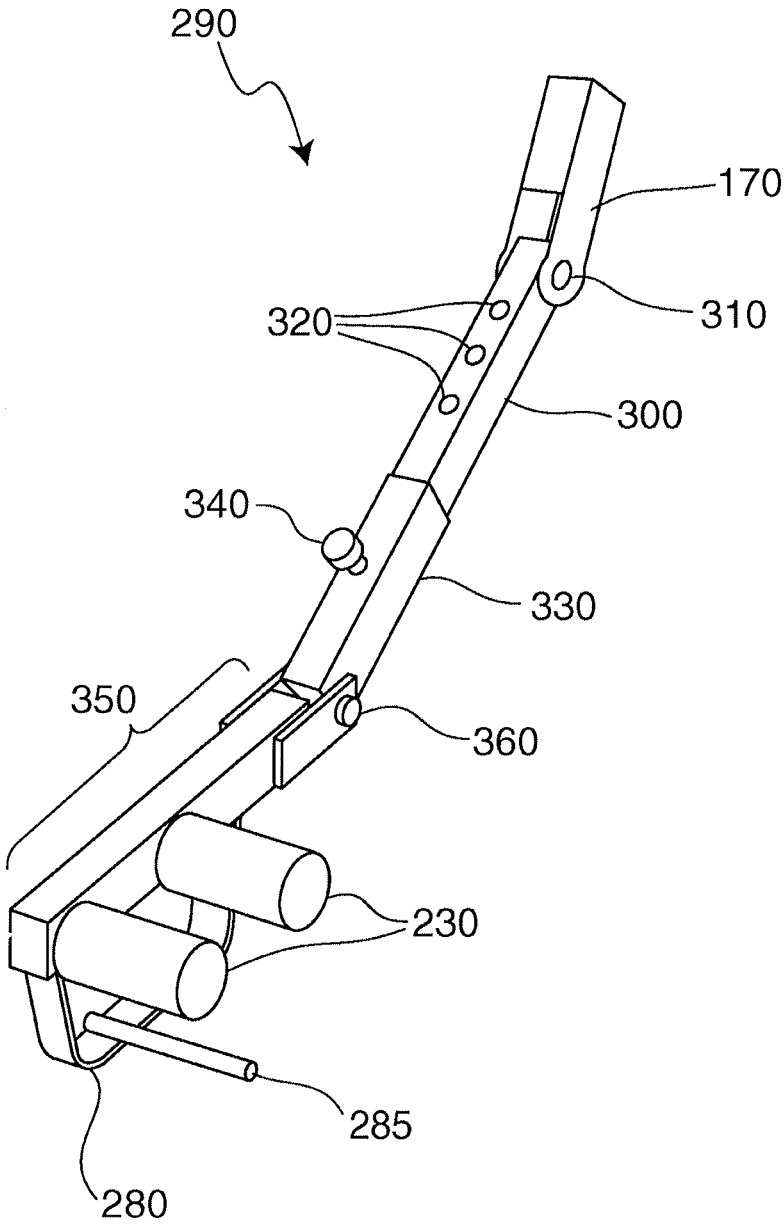
FIG. 4 is a detailed view of an alternate embodiment of a resistance transfer apparatus.

FIG. 4 shows detail of an alternate embodiment (290) where the pivoting linkage (210) is replaced by a bar comprising two sections (300,330). A first section (300) is pivotably connected by a pivot (310) to one of the respective arms (170) of the right pendulum (150) or left pendulum (160). The first section (300) has spaced holes (320). A second section (330) is connected as a sleeve over the first section (300) and adjustably locked thereto by a pin (340) fitting into one of the adjusting holes (320). In this way, the total length of the respective pendulums (150, 160) can be adjusted by moving the resistance transfer apparatus (350) of this embodiment nearer or farther from the end of the respective arms (170). As shown in FIG. 4, the resistance transfer apparatus (350) of this embodiment is connected to the second section (330) at a pivot (360).

Method of Use

Figure 5:
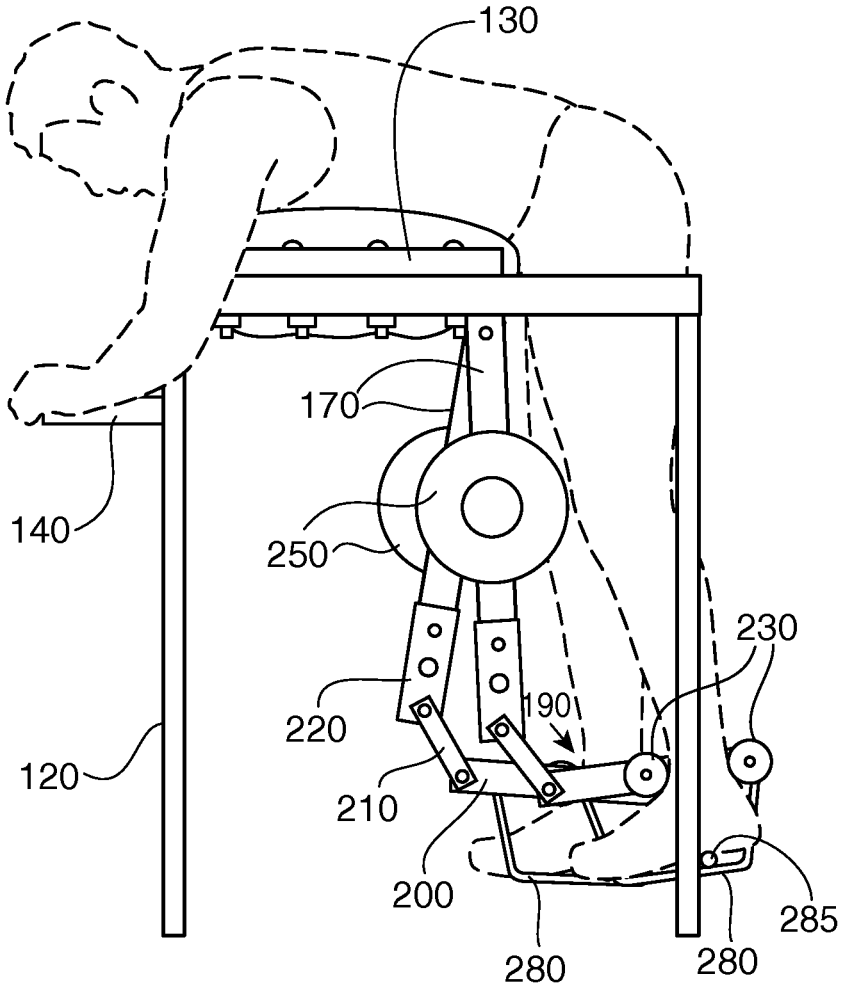
FIGS. 5-8 illustrate methods of using the disclosed embodiments to perform exercises for the lower back.
Figure 6:
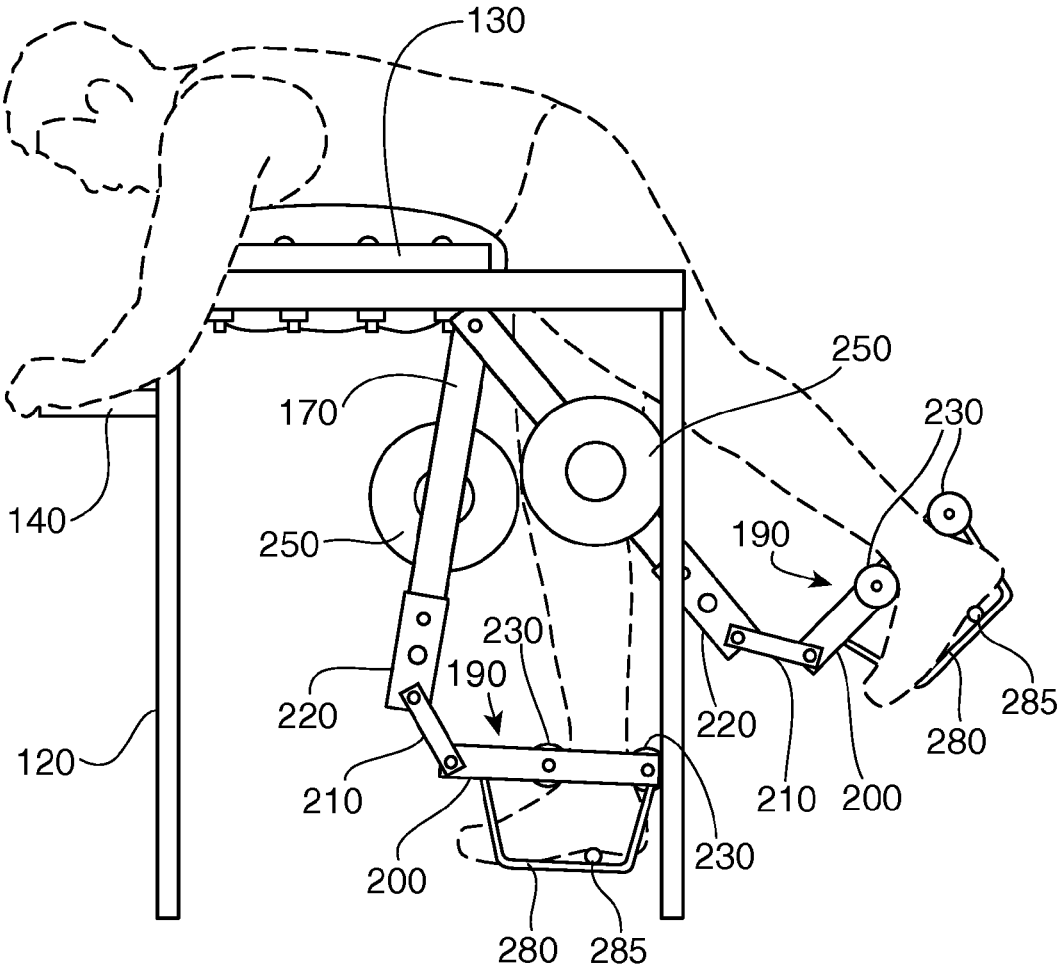
Figure 7:
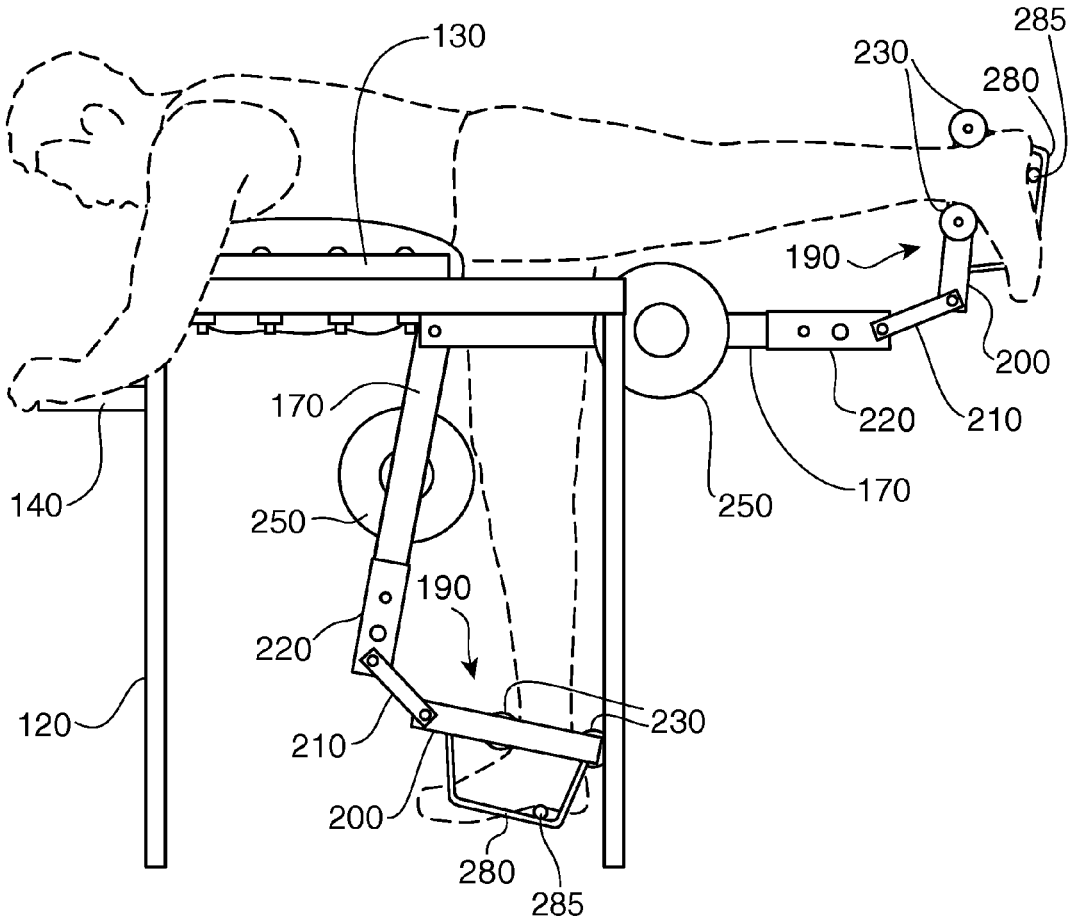

Using the embodiments illustrated in FIGS. 1-4, as an example, and as depicted in FIGS. 5-8, a user may mount the apparatus so that his or her torso to the waist is fully supported by body support platform (130). The user's lower legs pass through the resistance transfer apparatus (190). Weights (250) are shown in place on the posts (240). Preferably, the exercise is begun with the ankles passing through the ankle pads (230) of the resistance transfer apparatus (190). At this point, as shown in FIG. 5, the right pendulum (150) and the left pendulum (160) are substantially vertical with respect to the body support platform (130).

The exercise begins by the user contracting the muscles of the lower back (i.e., spinal erectors and hip flexors) and the gluteus maximus. The legs, working separately against the variable combined weight of the pendulums (150, 160) and thus the weights (250), are moved upward to a substantially horizontal position with respect to the body support platform (130), bringing the pivoting arms (170) upward as they pivot on their respective individual pivots (180). See FIGS. 6-7.

In the example shown, the pivoting linkage (210) connecting the pivoting arms (150) and the resistance transfer apparatus (190) allows the pivoting arms (170) and the attached ankle pads (230) to move so as to keep the pads (230) engaged with the user's legs, preferably at the ankles.

Figure 8:
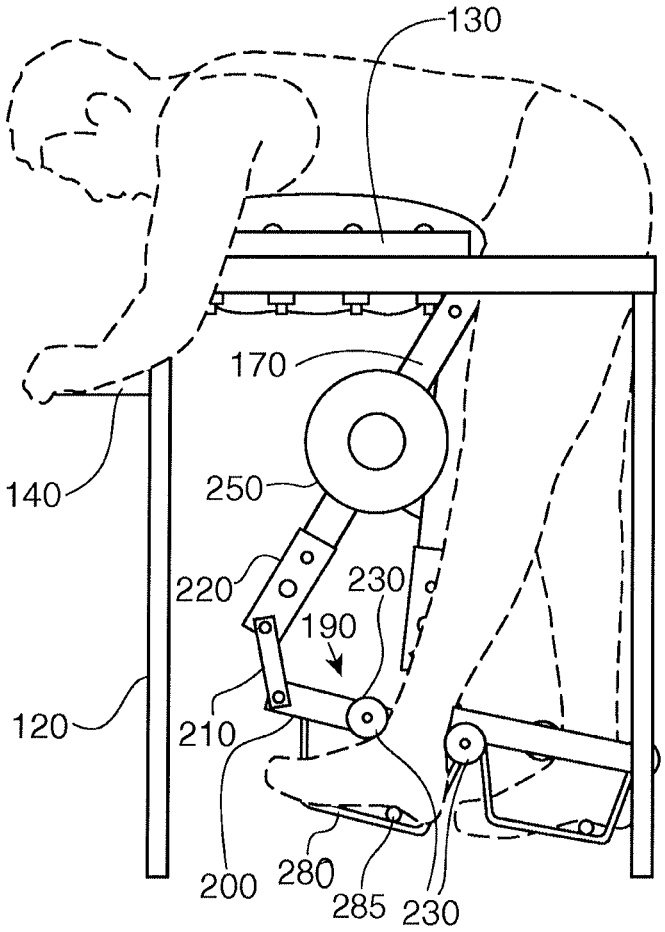

The user then lowers the legs, not by simply relaxing the muscles, but by lowering the legs using all the muscle groups of the upper legs and lower back. The legs are fully lowered to at least the vertical and then are pushed by muscle action forward past the vertical, as shown in FIG. 8. Thus, the total range of motion of the legs is greater than 90 degrees. After the user has pushed the legs as far past the vertical as he or she can, the exercise begins again by contracting the muscles and pushing the legs back to the horizontal. The exercise is then repeated the number of times desired by the user exercising.

The exercise is best performed as a smooth continuous action through the iterations. At all points in the exercise, the legs and correspondingly the affected muscles only push and are never pulled from one station to the next. The result is that hyperextension of muscles is avoided and the injured muscles of the lower back are permitted to receive an increase flow of blood. Additionally, in a user with an otherwise healthy lower back, the exercise builds up those lower back muscles thus avoiding future injury.

None of the description in this application should be read as implying that any particular element, step, or function is an essential element which must be included in the claim scope; the scope of patented subject matter is defined only by the allowed claims. Moreover, none of these claims are intended to invoke paragraph six of 35 U.S.C. Section 112 unless the exact words "means for" are used, followed by a gerund. The claims as filed are intended to be as comprehensive as possible, and no subject matter is intentionally relinquished, dedicated, or abandoned.

I claim:

1. An apparatus for exercise of the lower back, comprising:
- a support frame capable of supporting the body of a person exercising;
- left and right pendulums;
- each of the left and right pendulums further comprising:
  - an arm;
    - the arm having first and second ends;
    - the first end of the arm having a pivotable connection to the support frame,
  - so that each of the left and right pendulums may pivot about the pivotable connection independently of the other;
  - a first section pivotably connected to the second end of the arm;
  - a second section in length-adjustable engagement with the first section;
  - a resistance transfer apparatus; the resistance transfer apparatus further comprising:
    - a bar for engaging the lower leg or ankle of a person exercising; and,
    - a coupling for pivotably coupling the resistance transfer apparatus to the second section,
    - so that the resistance transfer apparatus can pivot in substantially the same plane of movement as that of the pendulum; a weight post for receiving weights; the weight post connected to the arm.

2. The apparatus for exercise of the lower back of claim 1, where the bar comprises one or more padded bars disposed substantially perpendicular to the plane of movement of the pendulum.

3. The apparatus for exercise of the lower back of claim 1, further comprising:
- a strap; the strap flexibly connected to the second end of the arm; the strap having a loop for engaging the lower leg or ankle of a person exercising.

* * * * *